US010708699B2

(12) United States Patent
Boesen

(10) Patent No.: US 10,708,699 B2
(45) Date of Patent: Jul. 7, 2020

(54) HEARING AID WITH ADDED FUNCTIONALITY

(71) Applicant: BRAGI GmbH, München (DE)

(72) Inventor: Peter Vincent Boesen, München (DE)

(73) Assignee: BRAGI GmbH, München (DE)

( * ) Notice: Subject to any disclaimer, the term of this patent is extended or adjusted under 35 U.S.C. 154(b) by 0 days.

(21) Appl. No.: 15/933,927

(22) Filed: Mar. 23, 2018

(65) Prior Publication Data

US 2018/0324535 A1 Nov. 8, 2018

Related U.S. Application Data

(60) Provisional application No. 62/500,855, filed on May 3, 2017.

(51) Int. Cl.
*H04R 25/00* (2006.01)

(52) U.S. Cl.
CPC ..... *H04R 25/70* (2013.01); *H04R 25/602* (2013.01); *H04R 25/305* (2013.01); *H04R 25/407* (2013.01); *H04R 25/55* (2013.01); *H04R 25/606* (2013.01); *H04R 2225/31* (2013.01); *H04R 2460/13* (2013.01)

(58) Field of Classification Search
CPC ..... H04R 25/70; H04R 25/305; H04R 25/55; H04R 2225/67; H04R 25/602; H04R 25/407; H04R 25/606
See application file for complete search history.

(56) References Cited

U.S. PATENT DOCUMENTS

| | | | |
|---|---|---|---|
| 2,325,590 | A | 8/1943 | Carlisle et al. |
| 2,430,229 | A | 11/1947 | Kelsey |
| 3,047,089 | A | 7/1962 | Zwislocki |
| D208,784 | S | 10/1967 | Sanzone |
| 3,586,794 | A | 6/1971 | Michaelis |
| 3,696,377 | A | 10/1972 | Wall |
| 3,934,100 | A | 1/1976 | Harada |

(Continued)

FOREIGN PATENT DOCUMENTS

| | | | |
|---|---|---|---|
| CN | 204244472 | U | 4/2015 |
| CN | 104683519 | A | 6/2015 |

(Continued)

OTHER PUBLICATIONS

Stretchgoal—The Carrying Case for the Dash (Feb. 12, 2014).

(Continued)

*Primary Examiner* — Sunita Joshi
(74) *Attorney, Agent, or Firm* — Goodhue, Coleman & Owens, P.C.

(57) ABSTRACT

A sound processing method for a hearing aid in embodiments of the present invention may have one of more of the following steps: (a) receiving a command from a user to begin an upload and/or download of a file, (b) initiating communications to commence the upload and/or download of the file, (c) selecting the file to upload and/or download to a memory on the hearing aid, (d) downloading and/or uploading the file into or out of the memory, (e) executing the file loaded into memory, (f) asking the user if they wish to download and/or upload another file to/from the memory, and (g) continuing normal hearing aid operations if the user does not wish to execute the file in the memory.

5 Claims, 9 Drawing Sheets

(56) References Cited

U.S. PATENT DOCUMENTS 3,983,336 A 9/1976 Malek et al.
4,069,400 A 1/1978 Johanson et al.
4,150,262 A 4/1979 Ono
4,334,315 A 6/1982 Ono et al.
D266,271 S 9/1982 Johanson et al.
4,375,016 A 2/1983 Harada
4,588,867 A 5/1986 Konomi
4,617,429 A 10/1986 Bellafiore
4,654,883 A 3/1987 Iwata
4,682,180 A 7/1987 Gans
4,791,673 A 12/1988 Schreiber
4,852,177 A 7/1989 Ambrose
4,865,044 A 9/1989 Wallace et al.
4,984,277 A 1/1991 Bisgaard et al.
5,008,943 A 4/1991 Arndt et al.
5,185,802 A 2/1993 Stanton
5,191,602 A 3/1993 Regen et al.
5,201,007 A 4/1993 Ward et al.
5,201,008 A 4/1993 Arndt et al.
D340,286 S 10/1993 Seo
5,280,524 A 1/1994 Norris
5,295,193 A 3/1994 Ono
5,298,692 A 3/1994 Ikeda et al.
5,343,532 A 8/1994 Shugart
5,347,584 A 9/1994 Narisawa
5,363,444 A 11/1994 Norris
5,444,786 A 8/1995 Raviv
D367,113 S 2/1996 Weeks
5,497,339 A 3/1996 Bernard
5,606,621 A 2/1997 Reiter et al.
5,613,222 A 3/1997 Guenther
5,654,530 A 8/1997 Sauer et al.
5,692,059 A 11/1997 Kruger
5,721,783 A 2/1998 Anderson
5,748,743 A 5/1998 Weeks
5,749,072 A 5/1998 Mazurkiewicz et al.
5,771,438 A 6/1998 Palermo et al.
D397,796 S 9/1998 Yabe et al.
5,802,167 A 9/1998 Hong
5,844,996 A 12/1998 Enzmann et al.
D410,008 S 5/1999 Almqvist
5,929,774 A 7/1999 Charlton
5,933,506 A 8/1999 Aoki et al.
5,949,896 A 9/1999 Nageno et al.
5,987,146 A 11/1999 Pluvinage et al.
6,021,207 A 2/2000 Puthuff et al.
6,054,989 A 4/2000 Robertson et al.
6,081,724 A 6/2000 Wilson
6,084,526 A 7/2000 Blotky et al.
6,094,492 A 7/2000 Boesen
6,111,569 A 8/2000 Brusky et al.
6,112,103 A 8/2000 Puthuff
6,157,727 A 12/2000 Rueda
6,167,039 A 12/2000 Karlsson et al.
6,181,801 B1 1/2001 Puthuff et al.
6,185,152 B1 2/2001 Shen
6,208,372 B1 3/2001 Barraclough
6,230,029 B1 5/2001 Yegiazaryan et al.
6,275,789 B1 8/2001 Moser et al.
6,339,754 B1 1/2002 Flanagan et al.
D455,835 S 4/2002 Anderson et al.
6,408,081 B1 6/2002 Boesen
6,424,820 B1 7/2002 Burdick et al.
D464,039 S 10/2002 Boesen
6,470,893 B1 10/2002 Boesen
D468,299 S 1/2003 Boesen
D468,300 S 1/2003 Boesen
6,542,721 B2 4/2003 Boesen
6,560,468 B1 5/2003 Boesen
6,563,301 B2 5/2003 Gventer
6,654,721 B2 11/2003 Handelman
6,664,713 B2 12/2003 Boesen
6,690,807 B1 2/2004 Meyer
6,694,180 B1 2/2004 Boesen
6,718,043 B1 4/2004 Boesen
6,738,485 B1 5/2004 Boesen
6,748,095 B1 6/2004 Goss
6,754,358 B1 6/2004 Boesen et al.
6,784,873 B1 8/2004 Boesen et al.
6,823,195 B1 11/2004 Boesen
6,852,084 B1 2/2005 Boesen
6,879,698 B2 4/2005 Boesen
6,892,082 B2 5/2005 Boesen
6,920,229 B2 7/2005 Boesen
6,952,483 B2 10/2005 Boesen et al.
6,987,986 B2 1/2006 Boesen
7,010,137 B1 3/2006 Leedom et al.
7,113,611 B2 9/2006 Leedom et al.
D532,520 S 11/2006 Kampmeier et al.
7,136,282 B1 11/2006 Rebeske
7,203,331 B2 4/2007 Boesen
7,209,569 B2 4/2007 Boesen
7,215,790 B2 5/2007 Boesen et al.
D549,222 S 8/2007 Huang
D554,756 S 11/2007 Sjursen et al.
7,403,629 B1 7/2008 Aceti et al.
D579,006 S 10/2008 Kim et al.
7,463,902 B2 12/2008 Boesen
7,508,411 B2 3/2009 Boesen
7,532,901 B1 5/2009 LaFranchise et al.
D601,134 S 9/2009 Elabidi et al.
7,825,626 B2 11/2010 Kozisek
7,859,469 B1 12/2010 Rosener et al.
7,965,855 B1 6/2011 Ham
7,979,035 B2 7/2011 Griffin et al.
7,983,628 B2 7/2011 Boesen
D647,491 S 10/2011 Chen et al.
8,095,188 B2 1/2012 Shi
8,108,143 B1 1/2012 Tester
8,140,357 B1 3/2012 Boesen
8,204,786 B2 6/2012 LeBoeuf et al.
D666,581 S 9/2012 Perez
8,300,864 B2 10/2012 Müllenborn et al.
8,379,871 B2 * 2/2013 Michael ..... H04R 5/04 381/312
8,406,448 B2 3/2013 Lin
8,430,817 B1 4/2013 Al-Ali et al.
8,436,780 B2 5/2013 Schantz et al.
8,437,860 B1 * 5/2013 Crawford ..... H04R 25/60 607/1
D687,021 S 7/2013 Yuen
8,679,012 B1 3/2014 Kayyali
8,719,877 B2 5/2014 VonDoenhoff et al.
8,774,434 B2 7/2014 Zhao et al.
8,831,266 B1 9/2014 Huang
8,891,800 B1 11/2014 Shaffer
8,994,498 B2 3/2015 Agrafioti et al.
D728,107 S 4/2015 Martin et al.
9,013,145 B2 4/2015 Castillo et al.
9,037,125 B1 5/2015 Kadous
D733,103 S 6/2015 Jeong et al.
9,081,944 B2 7/2015 Camacho et al.
9,461,403 B2 10/2016 Gao et al.
9,510,159 B1 11/2016 Cuddihy et al.
D773,439 S 12/2016 Walker
D775,158 S 12/2016 Dong et al.
D777,710 S 1/2017 Palmborg et al.
9,544,689 B2 1/2017 Fisher et al.
D788,079 S 5/2017 Son et al.
9,684,778 B2 6/2017 Tharappel et al.
9,711,062 B2 7/2017 Ellis et al.
9,729,979 B2 8/2017 Özden
9,755,704 B2 9/2017 Hviid et al.
9,767,709 B2 9/2017 Ellis
9,813,826 B2 11/2017 Hviid et al.
9,848,257 B2 12/2017 Ambrose et al.
9,949,008 B2 4/2018 Hviid et al.
2001/0005197 A1 6/2001 Mishra et al.
2001/0027121 A1 10/2001 Boesen
2001/0043707 A1 11/2001 Leedom
2001/0056350 A1 12/2001 Calderone et al.
2002/0002413 A1 1/2002 Tokue
2002/0007510 A1 1/2002 Mann
2002/0010590 A1 1/2002 Lee

(56) References Cited

U.S. PATENT DOCUMENTS

2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0102931 A1 5/2004 Ellis et al.
2004/0160511 A1 8/2004 Boesen
2005/0017842 A1 1/2005 Dematteo
2005/0043056 A1 2/2005 Boesen
2005/0094839 A1 5/2005 Gwee
2005/0125320 A1 6/2005 Boesen
2005/0148883 A1 7/2005 Boesen
2005/0165663 A1 7/2005 Razumov
2005/0196009 A1 9/2005 Boesen
2005/0197063 A1 9/2005 White
2005/0212911 A1 9/2005 Marvit et al.
2005/0251455 A1 11/2005 Boesen
2005/0266876 A1 12/2005 Boesen
2006/0029246 A1 2/2006 Boesen
2006/0073787 A1 4/2006 Lair et al.
2006/0074671 A1 4/2006 Farmaner et al.
2006/0074808 A1 4/2006 Boesen
2006/0166715 A1 7/2006 Engelen et al.
2006/0166716 A1 7/2006 Seshadri et al.
2006/0188116 A1* 8/2006 Frerking ..... H04M 1/6066 381/315
2006/0220915 A1 10/2006 Bauer
2006/0258412 A1 11/2006 Liu
2007/0102009 A1 5/2007 Wong et al.
2007/0239225 A1 10/2007 Saringer
2007/0269785 A1 11/2007 Yamanoi
2008/0076972 A1 3/2008 Dorogusker et al.
2008/0090622 A1 4/2008 Kim et al.
2008/0102424 A1 5/2008 Holljes
2008/0146890 A1 6/2008 LeBoeuf et al.
2008/0187163 A1* 8/2008 Goldstein ..... H04R 25/70 381/380
2008/0215239 A1 9/2008 Lee
2008/0253583 A1 10/2008 Goldstein et al.
2008/0254780 A1 10/2008 Kuhl et al.
2008/0255430 A1 10/2008 Alexandersson et al.
2008/0298606 A1 12/2008 Johnson et al.
2009/0003620 A1 1/2009 McKillop et al.
2009/0008275 A1 1/2009 Ferrari et al.
2009/0017881 A1 1/2009 Madrigal
2009/0041313 A1 2/2009 Brown
2009/0073070 A1 3/2009 Rofougaran
2009/0097689 A1 4/2009 Prest et al.
2009/0105548 A1 4/2009 Bart
2009/0154739 A1 6/2009 Zellner
2009/0191920 A1 7/2009 Regen et al.
2009/0226017 A1 9/2009 Abolfathi et al.
2009/0240947 A1 9/2009 Goyal et al.
2009/0245559 A1 10/2009 Boltyenkov et al.
2009/0261114 A1 10/2009 McGuire et al.
2009/0296968 A1 12/2009 Wu et al.
2009/0303073 A1 12/2009 Gilling et al.
2009/0304210 A1 12/2009 Weisman
2010/0033313 A1 2/2010 Keady et al.
2010/0075631 A1 3/2010 Black et al.
2010/0166206 A1 7/2010 Macours
2010/0203831 A1 8/2010 Muth
2010/0210212 A1 8/2010 Sato
2010/0245585 A1* 9/2010 Fisher ..... H04M 1/6066 348/164
2010/0290636 A1 11/2010 Mao et al.
2010/0320961 A1 12/2010 Castillo et al.
2011/0018731 A1 1/2011 Linsky et al.
2011/0103609 A1 5/2011 Pelland et al.
2011/0137141 A1 6/2011 Razoumov et al.
2011/0140844 A1 6/2011 McGuire et al.
2011/0239497 A1 10/2011 McGuire et al.
2011/0286615 A1 11/2011 Olodort et al.
2011/0293105 A1 12/2011 Arie et al.
2012/0057740 A1 3/2012 Rosal
2012/0155670 A1 6/2012 Rutschman
2012/0159617 A1 6/2012 Wu et al.
2012/0163626 A1 6/2012 Booij et al.
2012/0197737 A1 8/2012 LeBoeuf et al.
2012/0235883 A1 9/2012 Border et al.
2012/0309453 A1 12/2012 Maguire
2013/0106454 A1 5/2013 Liu et al.
2013/0154826 A1 6/2013 Ratajczyk
2013/0178967 A1 7/2013 Mentz
2013/0200999 A1 8/2013 Spodak et al.
2013/0204617 A1 8/2013 Kuo et al.
2013/0293494 A1 11/2013 Reshef
2013/0316642 A1 11/2013 Newham
2013/0346168 A1 12/2013 Zhou et al.
2014/0004912 A1 1/2014 Rajakarunanayake
2014/0014697 A1 1/2014 Schmierer et al.
2014/0020089 A1 1/2014 Perini, II
2014/0072136 A1 3/2014 Tenenbaum et al.
2014/0072146 A1 3/2014 Itkin et al.
2014/0073429 A1 3/2014 Meneses et al.
2014/0079257 A1 3/2014 Ruwe et al.
2014/0106677 A1 4/2014 Altman
2014/0122116 A1 5/2014 Smythe
2014/0146973 A1 5/2014 Liu et al.
2014/0153768 A1 6/2014 Hagen et al.
2014/0163771 A1 6/2014 Demeniuk
2014/0185828 A1 7/2014 Helbling
2014/0219467 A1 8/2014 Kurtz
2014/0222462 A1 8/2014 Shakil et al.
2014/0235169 A1 8/2014 Parkinson et al.
2014/0270227 A1 9/2014 Swanson
2014/0270271 A1 9/2014 Dehe et al.
2014/0276227 A1 9/2014 Pérez
2014/0310595 A1 10/2014 Acharya et al.
2014/0321682 A1 10/2014 Kofod-Hansen et al.
2014/0335908 A1 11/2014 Krisch et al.
2014/0348367 A1 11/2014 Vavrus et al.
2015/0002374 A1* 1/2015 Erinjippurath ..... G02B 27/0172 345/8
2015/0028996 A1 1/2015 Agrafioti et al.
2015/0035643 A1 2/2015 Kursun
2015/0036835 A1 2/2015 Chen
2015/0056584 A1 2/2015 Boulware et al.
2015/0078575 A1* 3/2015 Selig ..... H04R 1/1091 381/74
2015/0110587 A1 4/2015 Hori
2015/0148989 A1 5/2015 Cooper et al.
2015/0181356 A1 6/2015 Krystek et al.
2015/0230022 A1 8/2015 Sakai et al.
2015/0245127 A1 8/2015 Shaffer
2015/0256949 A1 9/2015 Vanpoucke et al.
2015/0264472 A1 9/2015 Aase
2015/0264501 A1 9/2015 Hu et al.
2015/0317565 A1 11/2015 Li et al.
2015/0358751 A1 12/2015 Deng et al.
2015/0359436 A1 12/2015 Shim et al.
2015/0364058 A1 12/2015 Lagree et al.
2015/0373467 A1 12/2015 Gelter
2015/0373474 A1 12/2015 Kraft et al.
2015/0379251 A1 12/2015 Komaki
2016/0033280 A1 2/2016 Moore et al.
2016/0034249 A1 2/2016 Lee et al.
2016/0071526 A1 3/2016 Wingate et al.
2016/0072558 A1 3/2016 Hirsch et al.
2016/0073189 A1 3/2016 Lindén et al.
2016/0094550 A1 3/2016 Bradley et al.
2016/0100262 A1 4/2016 Inagaki
2016/0119737 A1 4/2016 Mehnert et al.
2016/0124707 A1 5/2016 Ermilov et al.
2016/0125892 A1 5/2016 Bowen et al.
2016/0140870 A1 5/2016 Connor

(56) References Cited

U.S. PATENT DOCUMENTS

| | | | |
|---|---|---|---|
| 2016/0142818 | A1 | 5/2016 | Park |
| 2016/0162259 | A1 | 6/2016 | Zhao et al. |
| 2016/0209691 | A1 | 7/2016 | Yang et al. |
| 2016/0253994 | A1 | 9/2016 | Panchapagesan et al. |
| 2016/0324478 | A1 | 11/2016 | Goldstein |
| 2016/0353196 | A1 | 12/2016 | Baker et al. |
| 2016/0360350 | A1 | 12/2016 | Watson et al. |
| 2017/0021257 | A1 | 1/2017 | Gilbert et al. |
| 2017/0046503 | A1 | 2/2017 | Cho et al. |
| 2017/0059152 | A1 | 3/2017 | Hirsch et al. |
| 2017/0060262 | A1 | 3/2017 | Hviid et al. |
| 2017/0060269 | A1 | 3/2017 | Förstner et al. |
| 2017/0061751 | A1 | 3/2017 | Loermann et al. |
| 2017/0061817 | A1 | 3/2017 | Mettler May |
| 2017/0062913 | A1 | 3/2017 | Hirsch et al. |
| 2017/0064426 | A1 | 3/2017 | Hviid |
| 2017/0064428 | A1 | 3/2017 | Hirsch |
| 2017/0064432 | A1 | 3/2017 | Hviid et al. |
| 2017/0064437 | A1 | 3/2017 | Hviid et al. |
| 2017/0078780 | A1 | 3/2017 | Qian et al. |
| 2017/0078785 | A1 | 3/2017 | Qian et al. |
| 2017/0100277 | A1 | 4/2017 | Ke |
| 2017/0108918 | A1 | 4/2017 | Boesen |
| 2017/0109131 | A1 | 4/2017 | Boesen |
| 2017/0110124 | A1 | 4/2017 | Boesen et al. |
| 2017/0110899 | A1 | 4/2017 | Boesen |
| 2017/0111723 | A1 | 4/2017 | Boesen |
| 2017/0111725 | A1 | 4/2017 | Boesen et al. |
| 2017/0111726 | A1 | 4/2017 | Martin et al. |
| 2017/0111740 | A1 | 4/2017 | Hviid et al. |
| 2017/0127168 | A1 | 5/2017 | Briggs et al. |
| 2017/0131094 | A1 | 5/2017 | Kulik |
| 2017/0142511 | A1* | 5/2017 | Dennis ..... H04R 1/1083 |
| 2017/0146801 | A1 | 5/2017 | Stempora |
| 2017/0150920 | A1 | 6/2017 | Chang et al. |
| 2017/0151085 | A1 | 6/2017 | Chang et al. |
| 2017/0151447 | A1 | 6/2017 | Boesen |
| 2017/0151668 | A1 | 6/2017 | Boesen |
| 2017/0151918 | A1 | 6/2017 | Boesen |
| 2017/0151930 | A1 | 6/2017 | Boesen |
| 2017/0151957 | A1 | 6/2017 | Boesen |
| 2017/0151959 | A1 | 6/2017 | Boesen |
| 2017/0153114 | A1 | 6/2017 | Boesen |
| 2017/0153636 | A1 | 6/2017 | Boesen |
| 2017/0154532 | A1 | 6/2017 | Boesen |
| 2017/0155985 | A1 | 6/2017 | Boesen |
| 2017/0155992 | A1 | 6/2017 | Perianu et al. |
| 2017/0155993 | A1 | 6/2017 | Boesen |
| 2017/0155997 | A1 | 6/2017 | Boesen |
| 2017/0155998 | A1 | 6/2017 | Boesen |
| 2017/0156000 | A1 | 6/2017 | Boesen |
| 2017/0164890 | A1 | 6/2017 | Leip et al. |
| 2017/0178631 | A1 | 6/2017 | Boesen |
| 2017/0180842 | A1 | 6/2017 | Boesen |
| 2017/0180843 | A1 | 6/2017 | Perianu et al. |
| 2017/0180897 | A1 | 6/2017 | Perianu |
| 2017/0188127 | A1 | 6/2017 | Perianu et al. |
| 2017/0188132 | A1 | 6/2017 | Hirsch et al. |
| 2017/0193978 | A1 | 7/2017 | Goldman |
| 2017/0195829 | A1 | 7/2017 | Belverato et al. |
| 2017/0208393 | A1 | 7/2017 | Boesen |
| 2017/0214987 | A1 | 7/2017 | Boesen |
| 2017/0215016 | A1 | 7/2017 | Dohmen et al. |
| 2017/0230752 | A1 | 8/2017 | Dohmen et al. |
| 2017/0251933 | A1 | 9/2017 | Braun et al. |
| 2017/0257698 | A1 | 9/2017 | Boesen et al. |
| 2017/0258329 | A1 | 9/2017 | Marsh |
| 2017/0263236 | A1 | 9/2017 | Boesen et al. |
| 2017/0263376 | A1 | 9/2017 | Verschueren et al. |
| 2017/0266494 | A1 | 9/2017 | Crankson et al. |
| 2017/0273622 | A1 | 9/2017 | Boesen |
| 2017/0280257 | A1 | 9/2017 | Gordon et al. |
| 2017/0301337 | A1 | 10/2017 | Golani et al. |
| 2017/0361213 | A1 | 12/2017 | Goslin et al. |
| 2017/0366233 | A1 | 12/2017 | Hviid et al. |
| 2018/0007994 | A1 | 1/2018 | Boesen et al. |
| 2018/0008194 | A1 | 1/2018 | Boesen |
| 2018/0008198 | A1 | 1/2018 | Kingscott |
| 2018/0009447 | A1 | 1/2018 | Boesen et al. |
| 2018/0011006 | A1 | 1/2018 | Kingscott |
| 2018/0011682 | A1 | 1/2018 | Milevski et al. |
| 2018/0011994 | A1 | 1/2018 | Boesen |
| 2018/0012228 | A1 | 1/2018 | Milevski et al. |
| 2018/0013195 | A1 | 1/2018 | Hviid et al. |
| 2018/0014102 | A1 | 1/2018 | Hirsch et al. |
| 2018/0014103 | A1 | 1/2018 | Martin et al. |
| 2018/0014104 | A1 | 1/2018 | Boesen et al. |
| 2018/0014107 | A1 | 1/2018 | Razouane et al. |
| 2018/0014108 | A1 | 1/2018 | Dragicevic et al. |
| 2018/0014109 | A1 | 1/2018 | Boesen |
| 2018/0014113 | A1 | 1/2018 | Boesen |
| 2018/0014140 | A1 | 1/2018 | Milevski et al. |
| 2018/0014436 | A1 | 1/2018 | Milevski |
| 2018/0034951 | A1 | 2/2018 | Boesen |
| 2018/0040093 | A1 | 2/2018 | Boesen |
| 2018/0042501 | A1 | 2/2018 | Adi et al. |

FOREIGN PATENT DOCUMENTS

| | | | |
|---|---|---|---|
| CN | 104837094 | A | 8/2015 |
| EP | 1469659 | A1 | 10/2004 |
| EP | 1017252 | A3 | 5/2006 |
| EP | 2903186 | A1 | 8/2015 |
| GB | 2074817 | | 4/1981 |
| GB | 2508226 | A | 5/2014 |
| JP | 06292195 | | 10/1998 |
| WO | 2008103925 | A1 | 8/2008 |
| WO | 2008113053 | A1 | 9/2008 |
| WO | 2007034371 | A3 | 11/2008 |
| WO | 2011001433 | A2 | 1/2011 |
| WO | 2012071127 | A1 | 5/2012 |
| WO | 2013134956 | A1 | 9/2013 |
| WO | 2014046602 | A1 | 3/2014 |
| WO | 2014043179 | A3 | 7/2014 |
| WO | 2015061633 | A2 | 4/2015 |
| WO | 2015110577 | A1 | 7/2015 |
| WO | 2015110587 | A1 | 7/2015 |
| WO | 2016032990 | A1 | 3/2016 |
| WO | 2016187869 | A1 | 12/2016 |

OTHER PUBLICATIONS

Stretchgoal—Windows Phone Support (Feb. 17, 2014).

The Dash + The Charging Case & The BRAGI News (Feb. 21, 2014).

The Dash—A Word From Our Software, Mechanical and Acoustics Team + An Update (Mar. 11, 2014).

Update From BRAGI—$3,000,000—Yipee (Mar. 22, 2014).

Weisiger; "Conjugated Hyperbilirubinemia", Jan. 5, 2016.

Wertzner et al., "Analysis of fundamental frequency, jitter, shimmer and vocal intensity in children with phonological disorders", V. 71, n.5, 582-588, Sep./Oct. 2005; Brazilian Journal of Othrhinolaryngology.

Wikipedia, "Gamebook", https://en.wikipedia.org/wiki/Gamebook, Sep. 3, 2017, 5 pages.

Wikipedia, "Kinect", "https://en.wikipedia.org/wiki/Kinect", 18 pages, (Sep. 9, 2017).

Wikipedia, "Wii Balance Board", "https://en.wikipedia.org/wiki/Wii_Balance_Board", 3 pages, (Jul. 20, 2017).

Akkermans, "Acoustic Ear Recognition for Person Identification", Automatic Identification Advanced Technologies, 2005 pp. 219-223.

Alzahrani et al: "A Multi-Channel Opto-Electronic Sensor to Accurately Monitor Heart Rate against Motion Artefact during Exercise", Sensors, vol. 15, No. 10, Oct. 12, 2015, pp. 25681-25702, XPO55334602, DOI: 10.3390/s151025681 the whole document.

Announcing the $3,333,333 Stretch Goal (Feb. 24, 2014).

Ben Coxworth: "Graphene-based ink could enable low-cost, foldable electronics", "Journal of Physical Chemistry Letters", Northwestern University, (May 22, 2013).

(56) References Cited

OTHER PUBLICATIONS

Blain: "World's first graphene speaker already superior to Sennheiser MX400", htt://www.gizmag.com/graphene-speaker-beats-sennheiser-mx400/31660, (Apr. 15, 2014).
BMW, "BMW introduces BMW Connected—The personalized digital assistant", "http://bmwblog.com/2016/01/05/bmw-introduces-bmw-connected-the-personalized-digital-assistant", (Jan. 5, 2016).
BRAGI Is on Facebook (2014).
BRAGI Update—Arrival of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready to Rumble, A Lot to Be Done Over Christmas (Dec. 22, 2014).
BRAGI Update—Memories From April—Update on Progress (Sep. 16, 2014).
BRAGI Update—Memories from May—Update on Progress—Sweet (Oct. 13, 2014).
BRAGI Update—Memories From One Month Before Kickstarter—Update on Progress (Jul. 10, 2014).
BRAGI Update—Memories From the First Month of Kickstarter—Update on Progress (Aug. 1, 2014).
BRAGI Update—Memories From the Second Month of Kickstarter—Update on Progress (Aug. 22, 2014).
BRAGI Update—New People @BRAGI—Prototypes (Jun. 26, 2014).
BRAGI Update—Office Tour, Tour to China, Tour to CES (Dec. 11, 2014).
BRAGI Update—Status on Wireless, Bits and Pieces, Testing—Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back to China, Backer Day, on Track(May 16, 2015).
BRAGI Update—Beta2 Production and Factory Line(Aug. 20, 2015).
BRAGI Update—Certifications, Production, Ramping Up (Nov. 13, 2015).
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2015).
BRAGI Update—On Track, Design Verification, How It Works and What's Next(Jul. 15, 2015).
BRAGI Update—On Track, On Track and Gems Overview (Jun. 24, 2015).
BRAGI Update—Status on Wireless, Supply, Timeline and Open House@BRAGI(Apr. 1, 2015).
BRAGI Update—Unpacking Video, Reviews on Audio Perform and Boy Are We Getting Close(Sep. 10, 2015).
Healthcare Risk Management Review, "Nuance updates computer-assisted physician documentation solution" (Oct. 20, 2016).
Hoffman, "How to Use Android Beam to Wirelessly Transfer Content Between Devices", (Feb. 22, 2013).
Hoyt et. al., "Lessons Learned from Implementation of Voice Recognition for Documentation in the Military Electronic Health Record System", The American Health Information Management Association (2017).
Hyundai Motor America, "Hyundai Motor Company Introduces a Health + Mobility Concept for Wellness in Mobility", Fountain Valley, Californa (2017).
International Search Report & Written Opinion, PCT/EP16/70245 (dated Nov. 16, 2016).
International Search Report & Written Opinion, PCT/EP2016/070231 (dated Nov. 18, 2016).
International Search Report & Written Opinion, PCT/EP2016/070247 (dated Nov. 18, 2016).
International Search Report & Written Opinion, PCT/EP2016/07216 (dated Oct. 18, 2016).
International Search Report and Written Opinion, PCT/EP2016/070228 (dated Jan. 9, 2017).
Jain A et al: "Score normalization in multimodal biometric systems", Pattern Recognition, Elsevier, GB, vol. 38, No. 12, Dec. 31, 2005, pp. 2270-2285, XPO27610849, ISSN: 0031-3203.
Last Push Before the Kickstarter Campaign Ends on Monday 4pm CET (Mar. 28, 2014).
Lovejoy: "Touch ID built into iPhone display one step closer as third-party company announces new tech", "http://9to5mac.com/2015/07/21/virtualhomebutton/" (Jul. 21, 2015).
Nemanja Paunovic et al, "A methodology for testing complex professional electronic systems", Serbian Journal of Electrical Engineering, vol. 9, No. 1, Feb. 1, 2012, pp. 71-80, XPO55317584, Yu.
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Nuance, "ING Netherlands Launches Voice Biometrics Payment System in the Mobile Banking App Powered by Nuance", "https://www.nuance.com/about-us/newsroom/press-releases/ing-netherlands-launches-nuance-voice-biometrics.html", 4 pages (Jul. 28, 2015).
Staab, Wayne J., et al., "A One-Size Disposable Hearing Aid is Introduced", The Hearing Journal 53(4):36-41) Apr. 2000.
Stretchgoal—Its Your Dash (Feb. 14, 2014).

* cited by examiner

HEARING AID WITH ADDED FUNCTIONALITY

PRIORITY STATEMENT

This application claims priority to U.S. Provisional Patent Application No. 62/500,855 filed on May 3, 2017 titled Hearing Aid with Added Functionality, all of which is hereby incorporated by reference in its entirety.

FIELD OF THE INVENTION

The present invention relates to hearing aids. Particularly, the present invention relates to audio, music and other forms of auditory enjoyment for a user. More particularly, the present invention relates to hearing aids providing improved auditory enjoyment for a user.

BACKGROUND

Hearing aids generally include a microphone, speaker and an amplifier. Other hearing aids assist with amplifying sound within an environment or frequencies of sound. Hearing aids have limited utility to individuals who wear them. What is needed is an improved hearing aid with added functionality.

Individuals vary in sensitivity to sound at different frequency bands, and this individual sensitivity may be measured using an audiometer to develop a hearing profile for different individuals. An individual's hearing profile may change with time and may vary markedly in different environments. However, audiometric testing may require specialized skills and equipment, and may therefore be relatively inconvenient or expensive. At the same time, use of hearing profile data is generally limited to applications related to medical hearing aids. Use of hearing profile data is generally not available in consumer electronic devices used for listening to audio output, referred to herein as personal listening devices.

Various player/listening devices are known in the art for providing audio output to a user. For example, portable radios, tape players, CD players, iPod™, and cellular telephones are known to process analog or digital data input to provide an amplified analog audio signal for output to external speakers, headphones, earbuds, or the like. Many of such devices are provided in a portable, handheld form factor. Others, for example home stereo systems and television sets, are much larger and not generally considered portable. Whatever the size of prior art devices, prior art listening devices may be provided with equalizing amplifiers separating an audio signal into different frequency bands and amplifying each band separately in response to a control input. Control is typically done manually using an array of sliding or other controls provided in a user interface device, to set desired equalization levels for each frequency band. The user or a sound engineer may set the controls to achieve a desired sound in a given environment. Some listening systems provide preset equalization levels to achieve predefined effects, for example, a "concert hall" effect. However, prior art personal listening devices are not able to automatically set equalization levels personalized to compensate for any hearing deficiencies existing in an individual's hearing profile. In other words, prior art listening devices cannot automatically adjust their audio output to compensate for individual amplification needs.

It would be desirable, therefore, to provide a hearing aid able to enhance enjoyment of audio and music for those with hearing disabilities.

SUMMARY

Therefore, it is a primary object, feature, or advantage of the present invention to improve over the state of the art.

A hearing aid in embodiments of the present invention may have one or more of the following features: (a) a hearing aid housing, (b) a processor disposed within the hearing aid housing for processing sound signals based on settings to compensate for hearing loss of an individual according to a hearing loss profile, (c) at least one microphone for receiving sound signals to be processed, the at least one microphone operatively connected to the processor, (d) at least one speaker for outputting sound signals to a user after processing of the sound signals, (e) a memory disposed within the hearing aid housing and operatively connected to the processor wherein the hearing aid is configured to allow the individual to store files in the memory, (f) a rechargeable battery enclosed within the hearing aid housing, (g) a recharging interface operatively connected to the rechargeable battery to allow the rechargeable battery enclosed within the hearing aid housing to recharge, (h) a user interface operatively connected to the processor to allow the individual to communicate with the hearing aid, (i) a communications interface operatively connected to the processor to allow the hearing aid to communicate with another computing device, (j) a user interface operatively connected to the processor to allow the individual to communicate with the hearing aid, and (k) a communications interface operatively connected to the processor to allow the hearing aid to communicate with a computing device wherein the hearing aid is adapted to allow the individual to instruct the hearing aid using the user interface to receive a file from the computing device and store the file within the memory.

A sound processing method for a hearing aid in embodiments of the present invention may have one of more of the following steps: (a) receiving a command from a user to begin an upload and/or download of a file, (b) initiating communications to commence the upload and/or download of the file, (c) selecting the file to upload and/or download to a memory on the hearing aid, (d) downloading and/or uploading the file into or out of the memory, (e) executing the file loaded into memory, (f) asking the user if they wish to download and/or upload another file to/from the memory, and (g) continuing normal hearing aid operations if the user does not wish to execute the file in the memory.

One or more of these and/or other objects, features, or advantages of the present invention will become apparent from the specification and claims following. No single embodiment need provide every object, feature, or advantage. Different embodiments may have different objects, features, or advantages. Therefore, the present invention is not to be limited to or by any objects, features, or advantages stated herein.

BRIEF DESCRIPTION OF THE DRAWINGS

Illustrated embodiments of the present invention are described in detail below with reference to the attached drawing figures, which are incorporated by reference herein, and where.

Figure 1:
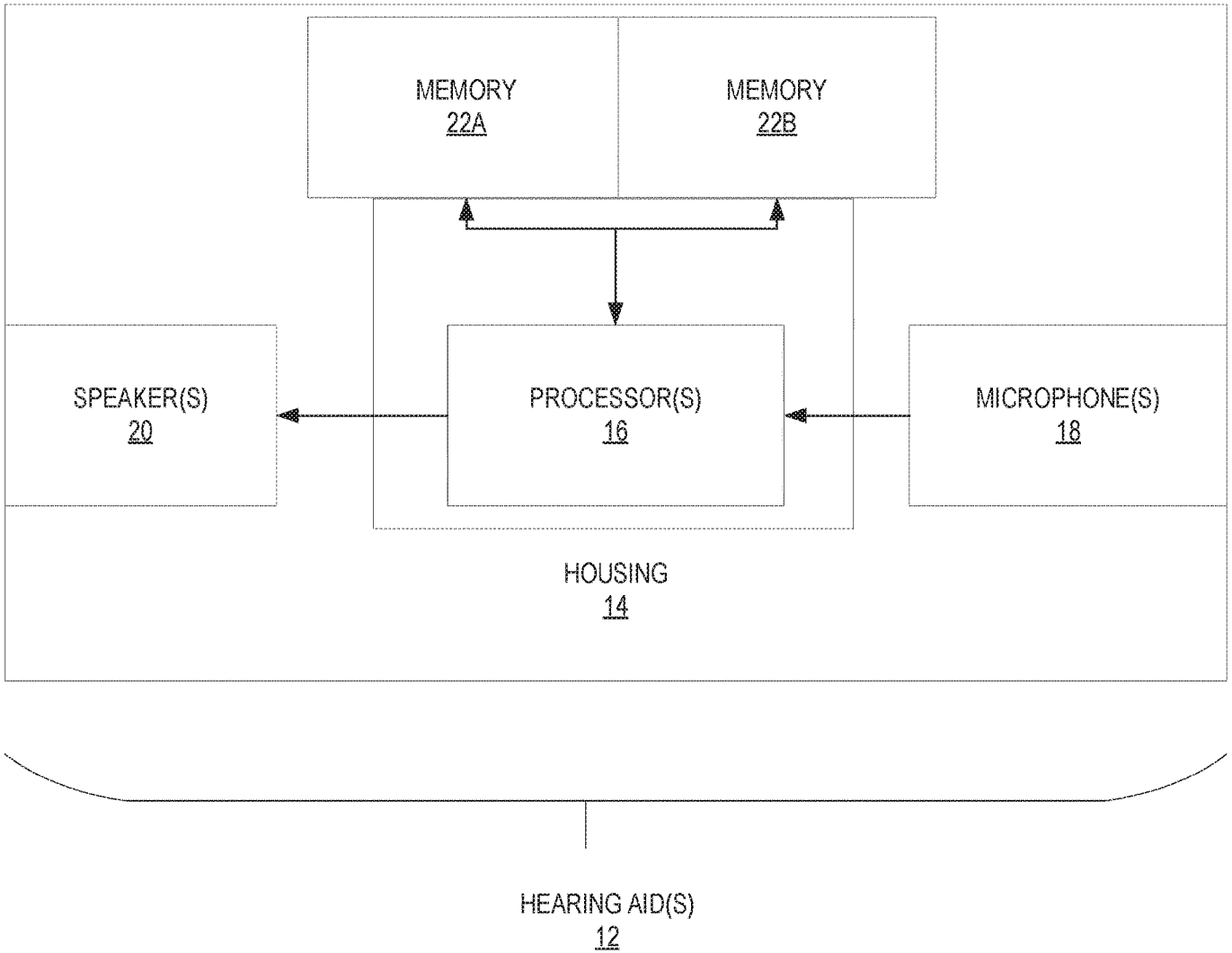
FIG. 1 shows a block diagram of a hearing aid in accordance with an embodiment of the present invention.

Some of the figures include graphical and ornamental elements. It is to be understood the illustrative embodiments contemplate all permutations and combinations of the various graphical elements set forth in the figures thereof.

DETAILED DESCRIPTION

The following discussion is presented to enable a person skilled in the art to make and use the present teachings. Various modifications to the illustrated embodiments will be plain to those skilled in the art, and the generic principles herein may be applied to other embodiments and applications without departing from the present teachings. Thus, the present teachings are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings. While embodiments of the present invention are discussed in terms of storage of audio on hearing aids, it is fully contemplated embodiments of the present invention could be used in most any aspect of hearing aids without departing from the spirit of the invention.

It is an object, feature, or advantage of the present invention to provide an improved hearing aid which includes additional functionality.

It is a still further object, feature, or advantage of the present invention to provide a hearing aid with user accessible storage which may be used to store user selected programs, audio files or other types of files.

It is another object, feature, or advantage to provide a hearing aid with a recharging interface to allow the hearing aid to be recharged without removing any battery.

According to one aspect a hearing aid or hearing assistive device is provided. The hearing aid includes a hearing aid housing, a processor disposed within the hearing aid housing for processing sound signals based on settings to compensate for hearing loss of an individual according to a hearing loss profile, at least one microphone for receiving sound signals to be processed, the at least one microphone operatively connected to the processor, at least one speaker for outputting sound signals to a user after processing of the sound signals, and a memory disposed within the hearing aid housing and operatively connected to the processor. The hearing aid is configured to allow the individual to store files in the memory. The files may be audio files such as music files or may be program files which may executed on the processor. The hearing aid may further include a rechargeable battery enclosed within the hearing aid housing and a recharging interface operatively connected to the rechargeable battery to allow the rechargeable battery enclosed within the hearing aid housing to recharge. The hearing aid may further include a user interface operatively connected to the processor to allow the individual to communicate with the hearing aid. The hearing aid may further include a communications interface operatively connected to the processor to allow the hearing aid to communicate with another computing device. The hearing aid may be adapted to allow the individual to instruct the hearing aid using the user interface to receive a file from the computing device and store the file within the memory. The file may be a program file for execution by the processor or an audio file for playback by the hearing aid or other type of file.

FIG. 1 shows a block diagram of one embodiment of a hearing aid 12. The hearing aid 12 contains a housing 14, a processor 16 operably coupled to the housing 14, at least one microphone 18 operably coupled to the housing 14 and the processor 16, a speaker 20 operably coupled to the housing 14 and the processor 16, and a memory 22 which is split into memory 22B and memory 22A. Each of the components may be arranged in any manner suitable to implement the hearing aid.

The housing 14 may be composed of plastic, metallic, nonmetallic, or any material or combination of materials having substantial deformation resistance to facilitate energy transfer if a sudden force is applied to the hearing aid 12. For example, if the hearing aid 12 is dropped by a user, the housing 14 may transfer the energy received from the surface impact throughout the entire hearing aid. In addition, the housing 14 may be capable of a degree of flexibility to facilitate energy absorbance if one or more forces is applied to the hearing aid 12. For example, if an object is dropped on the hearing aid 12, the housing 14 may bend to absorb the energy from the impact so the components within the hearing aid 12 are not substantially damaged. The flexibility of the housing 14 should not, however, be flexible to the point where one or more components of the earpiece may become dislodged or otherwise rendered non-functional if one or more forces is applied to the hearing aid 12.

In addition, the housing 14 may be configured to be worn in any manner suitable to the needs or desires of the hearing aid user. For example, the housing 14 may be configured to be worn behind the ear (BTE), wherein each of the components of the hearing aid 12, apart from the speaker 20, rest behind the ear. The speaker 20 may be operably coupled to an earmold and coupled to the other components of the hearing aid 12 by a coupling element. The speaker 20 may also be positioned to maximize the communications of sounds to the inner ear of the user. In addition, the housing 14 may be configured as an in-the-ear (ITE) hearing aid, which may be fitted on, at, or within (such as an in-the canal (ITC) or invisible-in-canal (IIC) hearing aid) an external auditory canal of a user. The housing 14 may additionally be configured to either completely occlude the external auditory canal or provide one or more conduits in which ambient sounds may travel to the user's inner ear.

One or more microphones 18 may be operably coupled to the housing 14 and the processor 16 and may be configured to receive sounds from the outside environment, one or more third or outside parties, or even from the user. One or more of the microphones 18 may be directional, bidirectional, or omnidirectional, and each of the microphones may be arranged in any configuration conducive to alleviating a user's hearing loss or difficulty. In addition, each microphone 18 may comprise an amplifier configured to amplify sounds received by a microphone by either a fixed factor or in accordance with one or more user settings of an algorithm stored within a memory device or the processor of the hearing aid 12. For example, if a user has special difficulty hearing high frequencies, a user may instruct the hearing aid 12 to amplify higher frequencies received by one or more of the microphones 18 by a greater percentage than lower or middle frequencies. The user may set the amplification of the microphones 18 using a voice command received by one of the microphones 18, a control panel or gestural interface on the hearing aid 12 itself, or a software application stored on an external electronic device such as a mobile phone or a tablet. Such settings may also be programmed by a factory or hearing professional. Sounds may also be amplified by an amplifier separate from the microphones 18 before being communicated to the processor 16 for sound processing.

One or more speakers 20 may be operably coupled to the housing 14 and the processor 16 and may be configured to produce sounds derived from signals communicated by the processor 16. The sounds produced by the speakers 20 may be ambient sounds, speech from a third party, speech from the user, media stored within the memory 22A or 22B of the hearing aid 12 or received from an outside source, information stored in the hearing aid 12 or received from an outside source, or a combination of one or more of the foregoing, and the sounds may be amplified, attenuated, or otherwise modified forms of the sounds originally received by the hearing aid 12. For example, the processor 16 may execute a program to remove background noise from sounds received by the microphones 18 to make a third-party voice within the sounds more audible, which may then be amplified or attenuated before being produced by one or more of the speakers 20. The speakers 20 may be positioned proximate to an outer opening of an external auditory canal of the user or may even be positioned proximate to a tympanic membrane of the user for users with moderate to severe hearing loss. In addition, one or more speakers 20 may be positioned proximate to a temporal bone of a user to conduct sound for people with limited hearing or complete hearing loss. Such positioning may even include anchoring the hearing aid 12 to the temporal bone.

The processor 16 may be disposed within the housing 14 and operably coupled to each component of the hearing aid 12 and may be configured to process sounds received by one or more microphones 18 in accordance with DSP (digital signal processing) algorithms stored in memory 22B. Furthermore, processor 16 can process sounds from audio files within memory 22A. Processor 16 can also process executable files stored on memory 22A by the user. These executable files can be downloaded to memory 22A as will be discussed in greater detail below. Memory 22A is allocated for a user to be able to download files to hearing aids 12. These files include audio files and executable files. Audio files include .wav, .mp3, .mpc, etc. and can be most any audio file presently available and in the future. Further, a user can download executable files which can function on hearing aids 12. These executables could include updated and improved DSP algorithms for processing sound, improved software for hearing aids 12 to increase functionality and most any executable file which could increase the functionality and efficiency of hearing aids 12.

Memory 22B could be memory set aside for the initial programming of the hearing aids 12 which could include the BIOS programming for the hearing aids 12 as well as any other required firmware for hearing aids 12. For ease of understanding, memory 22B could be thought of as memory allocated for the hearing aids 12 and memory 22A could be thought of as memory allocated for the user to enhance their hearing aid experience.

Figure 2:
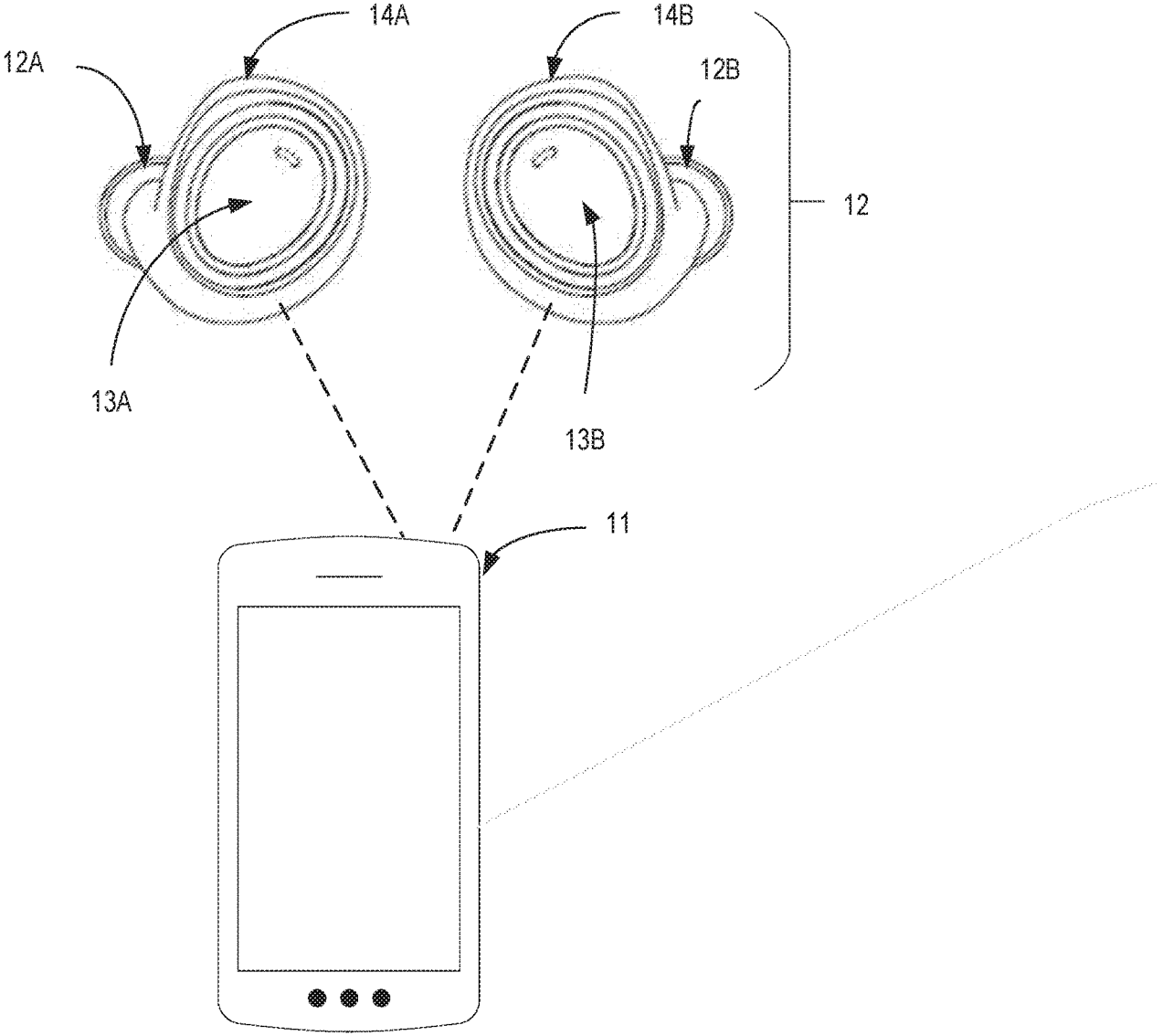
FIG. 2 illustrates a set of hearing aids in wireless communication with another device in accordance with an embodiment of the present invention.

The present invention relates to a hearing aid with additional functionality. FIG. 2 illustrates one example of a set of hearing aids 12 in wireless communication with another computing device 11 which may be a mobile device such as a mobile phone. Each hearing aid 12A, 12B has a respective hearing aid housing 14A, 14B. A user interface 13A, 13B is also shown on the respective hearing aids 12A, 12B. The user interface 13A, 13B may be a touch interface and include a surface which a user may touch to provide gestures. In addition, or as an alternative, the user interface may include a voice interface for receiving voice commands from a user and providing voice prompts to the user to interact with the user.

The hearing aid housing 14A, 14B may be of various sizes and styles including a behind-the-ear (BTE), mini BTE, in-the-ear (ITE), in-the-canal (ITC), completely-in-canal (CIC), or another configuration.

Figure 3:
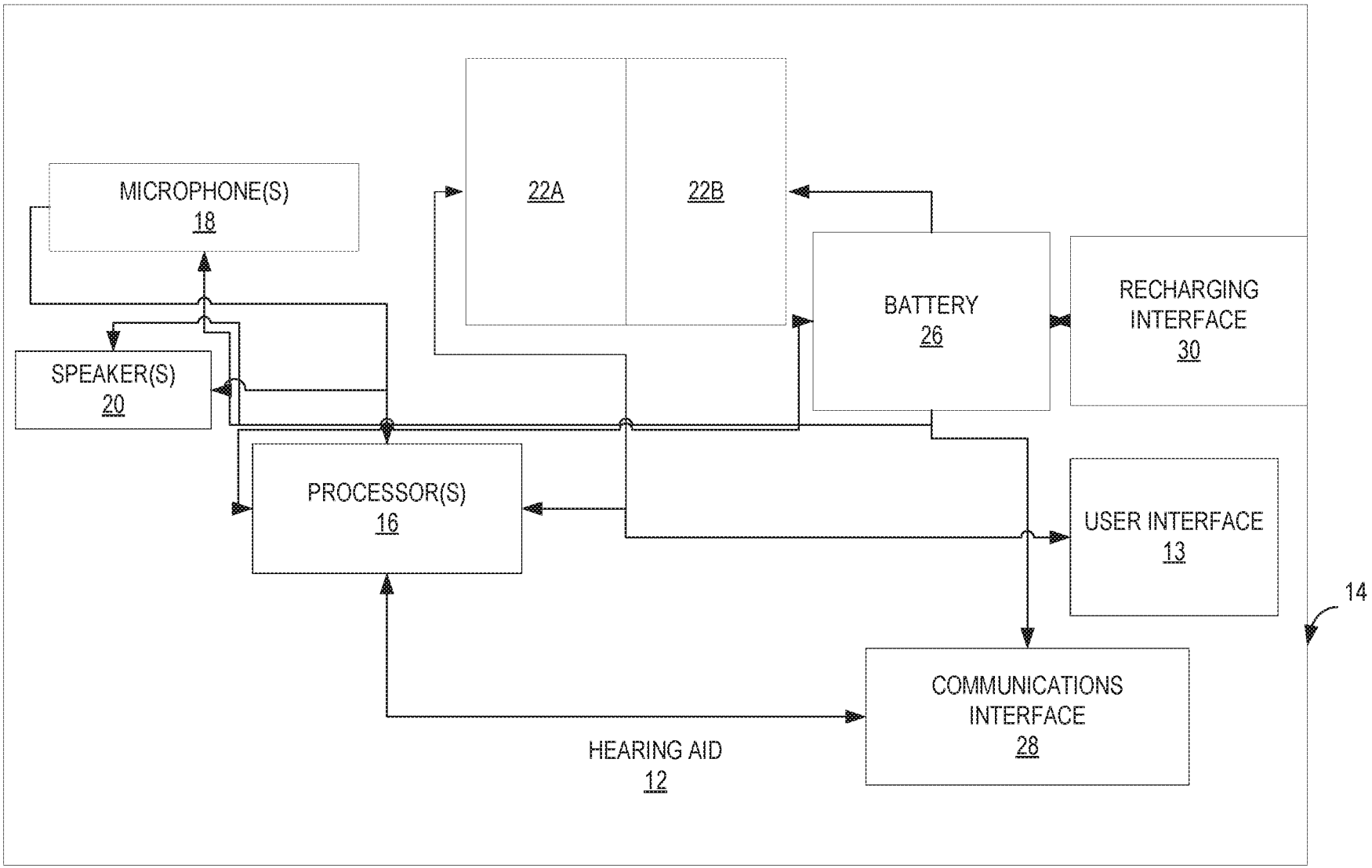
FIG. 3 is a block diagram of a hearing aid in accordance with an embodiment of the present invention.

FIG. 3 is a block diagram of a hearing aid 12. The hearing aid 12 has a hearing aid housing 14. Disposed within the hearing aid housing 14 are one or more processors 16. The processors may include a digital signal processor, a microcontroller, a microprocessor, or combinations thereof. One or more microphones 18 may be operatively connected to the processor(s) 16. The one or more microphones 18 may be used for receiving sound signals to be processed. The processor 16 may be used to process sound signals based on settings to compensate for hearing loss of an individual according to a hearing loss profile. The hearing loss profile may be constructed based on audiometric analysis performed by appropriate medical personnel. This may include settings to amplify some frequencies of sound signals detected by the one more microphones more than other frequencies of the sound signals.

One or more speakers 20 are also operatively connected to the processor 16 to reproduce or output sound signals to a user after processing of the sound signals by the processor 16 to amplify the sound signals detected by the one or more microphones 18 based on the hearing loss profile.

A battery 26 is enclosed within the hearing aid housing 12. The battery is a rechargeable battery. Instead of needing to remove the battery 26 to recharge, a recharging interface 30 may be present. The recharging interface may take on one of various forms. For example, the recharging interface 30 may include a connector for connecting the hearing aid 12 to a source of power for recharging. Alternatively, the recharging interface 30 may provide for wireless recharging of the battery 26. It is preferred the battery 26 is enclosed within the hearing aid housing 14 and not removable by the user during ordinary use.

A user interface 13 is also shown which is operatively connected to the processor 16. As previously explained, the user interface 13 may be a touch interface such as may be provided through use of an optical emitter and receiver pair or a capacitive sensor. Thus, a user may convey instructions to the hearing aid 12 through using the user interface 13.

A memory 22A & 22B is also operatively connected to the processor 16. The memory 22 is also disposed within the hearing aid housing 14. The memory 22A may be used to allow the individual to store files. The files may be audio files such as music files. The files may also be program files. Thus, although the hearing aid 12 may be programmed according to a hearing loss profile as determined by medical personnel, the hearing aid 12 may also include a user accessible memory 22A which allows a user to store, access, play, execute, or otherwise use files on the hearing aid 12. Where programming of the hearing aid 12 is stored in memory 22B, it is contemplated the programming of the hearing aid 12 may be locked and not accessible by the individual to access, delete, or replace such files. However, other files may be accessed including music files or other program files.

A communications interface 28 is also shown. The communications interface 28 may be a wired or wireless interface to allow the hearing aid 12 to communicate with another computing device to allow for the exchange of files including music files or program files between the other computing device and the hearing aid 12. The communications interface 28 provides a hard-wired connection, a Bluetooth connection, a BLE connection, or other type of connection.

Figure 4:
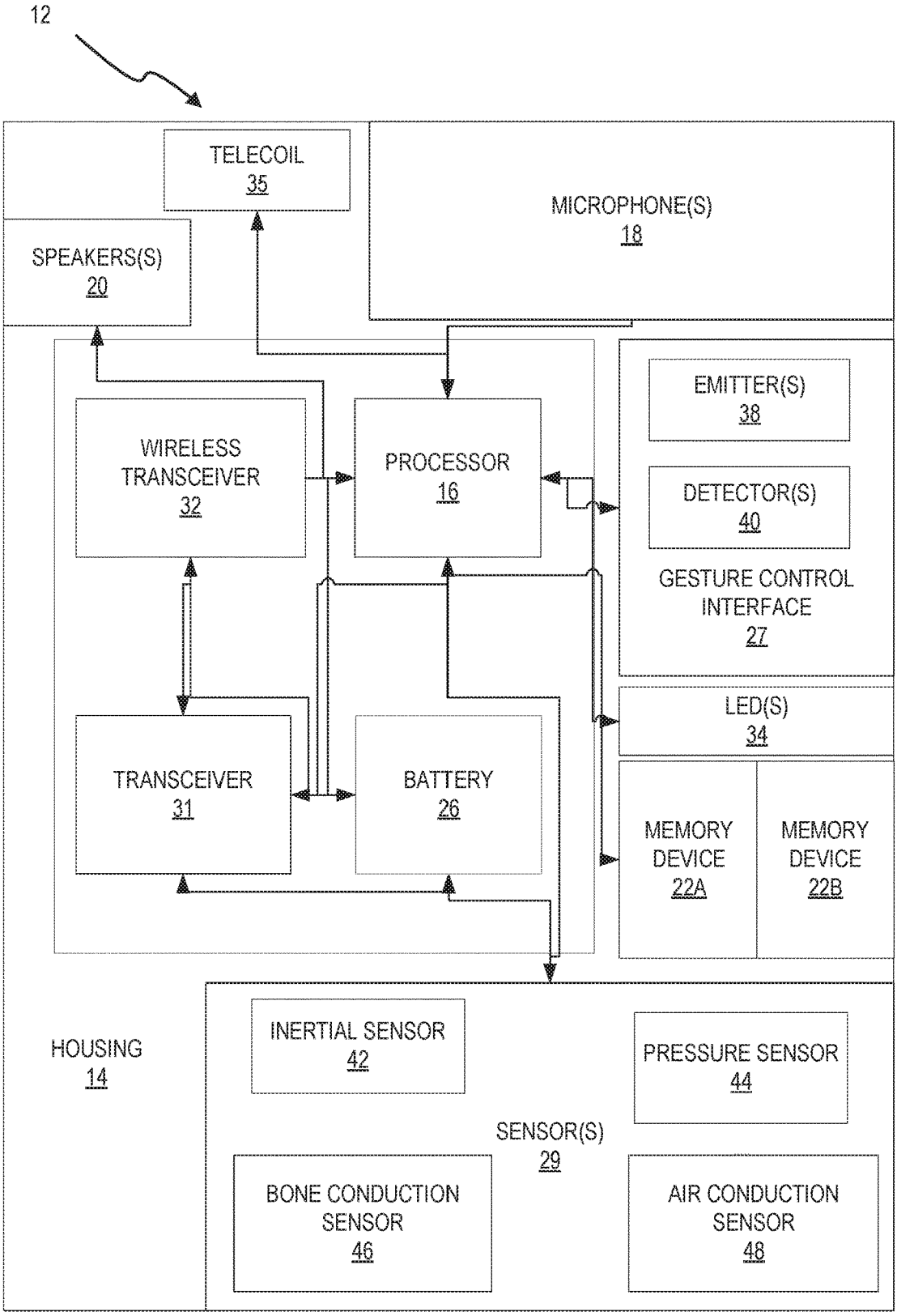
FIG. 4 shows a block diagram of a hearing aid in accordance with an embodiment of the present invention.

FIG. 4 illustrates another embodiment of the hearing aid 12. In addition to the elements described in FIGS. 1, 2 & 3 the hearing aid 12 may further comprise a memory device 22A & 22B operably coupled to the housing 14 and the processor 16, a gestural interface 26 operably coupled to the housing 14 and the processor 16, a sensor 29 operably coupled to the housing 14 and the processor 16, a transceiver 31 disposed within the housing 14 and operably coupled to the processor 16, a wireless transceiver 32 disposed within the housing 14 and operably coupled to the processor 16, one or more LEDs 34 operably coupled to the housing 14 and the processor 16, and a battery 26 disposed within the housing 14 and operably coupled to each component within the hearing aid 12. The housing 14, processor 16, microphones 18 and speaker 20 function substantially the same as described in FIGS. 1, 2 & 3 above, with differences regarding the additional components as described below.

Memory device 22A may be operably coupled to the housing 14 and the processor 16 and may be configured to store audio files, programming files and executable files. In addition, the memory device 22B may also store information related to sensor data and algorithms related to data analysis regarding the sensor data captured. In addition, the memory device 22B may store data or information regarding other components of the hearing aid 12. For example, the memory device 22B may store data or information encoded in signals received from the transceiver 30 or wireless transceiver 32, data or information regarding sensor readings from one or more sensors 29, algorithms governing command protocols related to the gesture interface 27, or algorithms governing LED 34 protocols. The foregoing list is non-exclusive.

Gesture interface 27 may be operably coupled to the housing 14 and the processor 16 and may be configured to allow a user to control one or more functions of the hearing aid 12. The gesture interface 27 may include at least one emitter 38 and at least one detector 40 to detect gestures from either the user, a third-party, an instrument, or a combination of the foregoing and communicate one or more signals representing the gesture to the processor 16. The gestures used with the gesture interface 27 to control the hearing aid 12 include, without limitation, touching, tapping, swiping, use of an instrument, or any combination of the gestures. Touching gestures used to control the hearing aid 12 may be of any duration and may include the touching of areas not part of the gesture control interface 27. Tapping gestures used to control the hearing aid 12 may include any number of taps and need not be brief. Swiping gestures used to control the hearing aid 12 may include a single swipe, a swipe changes direction at least once, a swipe with a time delay, a plurality of swipes, or any combination of the foregoing. An instrument used to control the hearing aid 12 may be electronic, biochemical or mechanical, and may interface with the gesture interface 27 either physically or electromagnetically.

One or more sensors 29 having an inertial sensor 42, a pressure sensor 44, a bone conduction sensor 46 and an air conduction sensor 48 may be operably coupled to the housing 14 and the processor 16 and may be configured to sense one or more user actions. The inertial sensor 42 may sense a user motion which may be used to modify a sound received at a microphone 18 to be communicated at a speaker 20. For example, a MEMS gyroscope, an electronic magnetometer, or an electronic accelerometer may sense a head motion of a user, which may be communicated to the processor 16 to be used to make one or more modifications to a sound received at a microphone 18. The pressure sensor 44 may be used to adjust one or more sounds received by one or more of the microphones 18 depending on the air pressure conditions at the hearing aid 12. In addition, the bone conduction sensor 46 and the air conduction sensor 48 may be used in conjunction to sense unwanted sounds and communicate the unwanted sounds to the processor 16 to improve audio transparency. For example, the bone conduction sensor 46, which may be positioned proximate a temporal bone of a user, may receive an unwanted sound faster than the air conduction sensor 48 due to the fact sound travels faster through most physical media than air and subsequently communicate the sound to the processor 16, which may apply a destructive interference noise cancellation algorithm to the unwanted sounds if substantially similar sounds are received by either the air conduction sensor 48 or one or more of the microphones 18. If not, the processor 16 may cease execution of the noise cancellation algorithm, as the noise likely emanates from the user, which the user may want to hear, though the function may be modified by the user.

Transceiver 31 may be disposed within the housing 14 and operably coupled to the processor 16 and may be configured to send or receive signals from another hearing aid if the user is wearing a hearing aid 12 in both ears. The transceiver 31 may receive or transmit more than one signal simultaneously. For example, a transceiver 31 in a hearing aid 12 worn at a right ear may transmit a signal encoding temporal data used to synchronize sound output with a hearing aid 12 worn at a left ear. The transceiver 31 may be of any number of types including a near field magnetic induction (NFMI) transceiver.

Wireless transceiver 32 may be disposed within the housing 14 and operably coupled to the processor 16 and may receive signals from or transmit signals to another electronic device. The signals received from or transmitted by the wireless transceiver 32 may encode data or information related to media or information related to news, current events, or entertainment, information related to the health of a user or a third party, information regarding the location of a user or third party, or the functioning of the hearing aid 12. For example, if a user expects to encounter a problem or issue with the hearing aid 12 due to an event the user becomes aware of while listening to a weather report using the hearing aid 12, the user may instruct the hearing aid 12 to communicate instructions regarding how to transmit a signal encoding the user's location and hearing status to a nearby audiologist or hearing aid specialist in order to rectify the problem or issue. More than one signal may be received from or transmitted by the wireless transceiver 32.

LEDs 34 may be operably coupled to the housing 14 and the processor 16 and may be configured to provide information concerning the earpiece. For example, the processor 16 may communicate a signal encoding information related to the current time, the battery life of the earpiece, the status of another operation of the earpiece, or another earpiece function to the LEDs 34 which decode and display the information encoded in the signals. For example, the processor 16 may communicate a signal encoding the status of the energy level of the earpiece, wherein the energy level may be decoded by LEDs 34 as a blinking light, wherein a green light may represent a substantial level of battery life, a yellow light may represent an intermediate level of battery life, and a red light may represent a limited amount of battery life, and a blinking red light may represent a critical level of battery life requiring immediate recharging. In addition, the battery life may be represented by the LEDs 34 as a percentage of battery life remaining or may be represented by an energy bar having one or more LEDs, wherein the number of illuminated LEDs represents the amount of battery life remaining in the earpiece. The LEDs 34 may be in any area on the hearing aid suitable for viewing by the user or a third party and may also consist of as few as one diode which may be provided in combination with a light guide. In addition, the LEDs 34 need not have a minimum luminescence.

Telecoil 35 may be operably coupled to the housing 14 and the processor 16 and may be configured to receive magnetic signals from a communications device in lieu of receiving sound through a microphone 18. For example, a user may instruct the hearing aid 12 using a voice command received via a microphone 18, providing a gesture to the gesture interface 27, or using a mobile device to cease reception of sounds at the microphones 18 and receive magnetic signals via the telecoil 35. The magnetic signals may be further decoded by the processor 16 and produced by the speakers 20. The magnetic signals may encode media or information the user desires to listen to.

Battery 26 is operably coupled to all the components within the hearing aid 12. The battery 26 may provide enough power to operate the hearing aid 12 for a reasonable duration of time. The battery 26 may be of any type suitable for powering the hearing aid 12. However, the battery 26 need not be present in the hearing aid 12. Alternative battery-less power sources, such as sensors configured to receive energy from radio waves (all of which are operably coupled to one or more hearing aids 12) may be used to power the hearing aid 12 in lieu of a battery 26.

Figure 5:
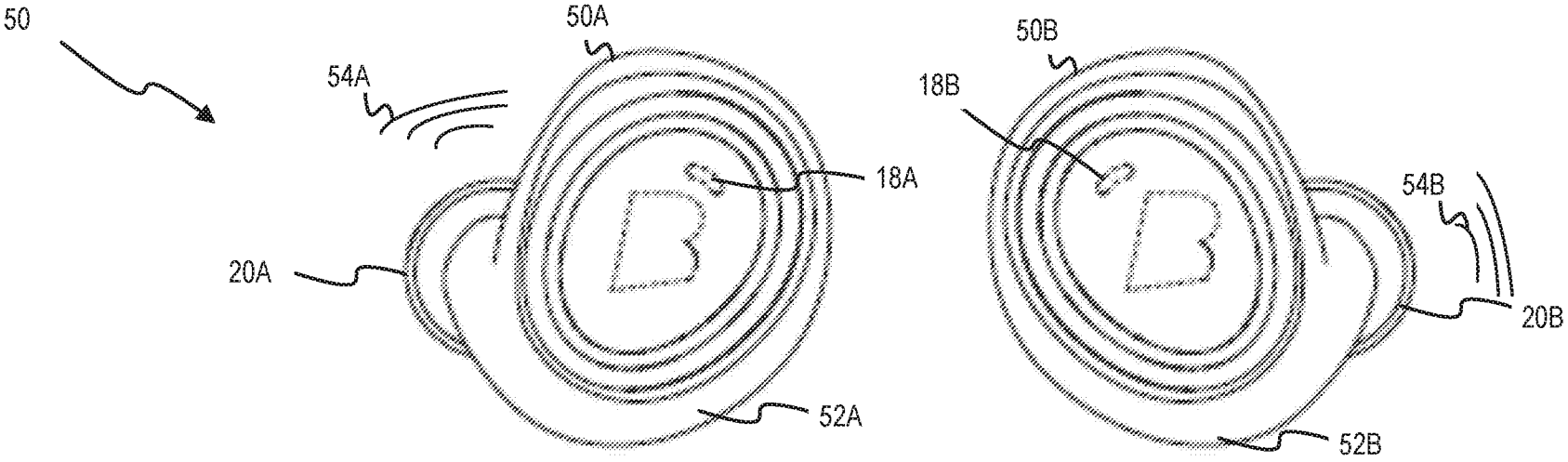
FIG. 5 illustrates a pair of hearing aids in accordance with an embodiment of the present invention.

FIG. 5 illustrates a pair of hearing aids 50 which includes a left hearing aid 50A and a right hearing aid 50B. The left hearing aid 50A has a left housing 52A. The right hearing aid 50B has a right housing 52B. The left hearing aid 50A and the right hearing aid 50B may be configured to fit on, at, or within a user's external auditory canal and may be configured to substantially minimize or eliminate external sound capable of reaching the tympanic membrane. The housings 52A and 52B may be composed of any material with substantial deformation resistance and may also be configured to be soundproof or waterproof. A microphone 18A is shown on the left hearing aid 50A and a microphone 18B is shown on the right hearing aid 50B. The microphones 18A and 18B may be located anywhere on the left hearing aid 50A and the right hearing aid 50B respectively and each microphone may be configured to receive one or more sounds from the user, one or more third parties, or one or more sounds, either natural or artificial, from the environment. Speakers 20A and 20B may be configured to communicate processed sounds 54A and 54B. The processed sounds 54A and 54B may be communicated to the user, a third party, or another entity capable of receiving the communicated sounds. Speakers 20A and 20B may also be configured to short out if the decibel level of the processed sounds 54A and 54B exceeds a certain decibel threshold, which may be preset or programmed by the user or a third party.

Figure 6:
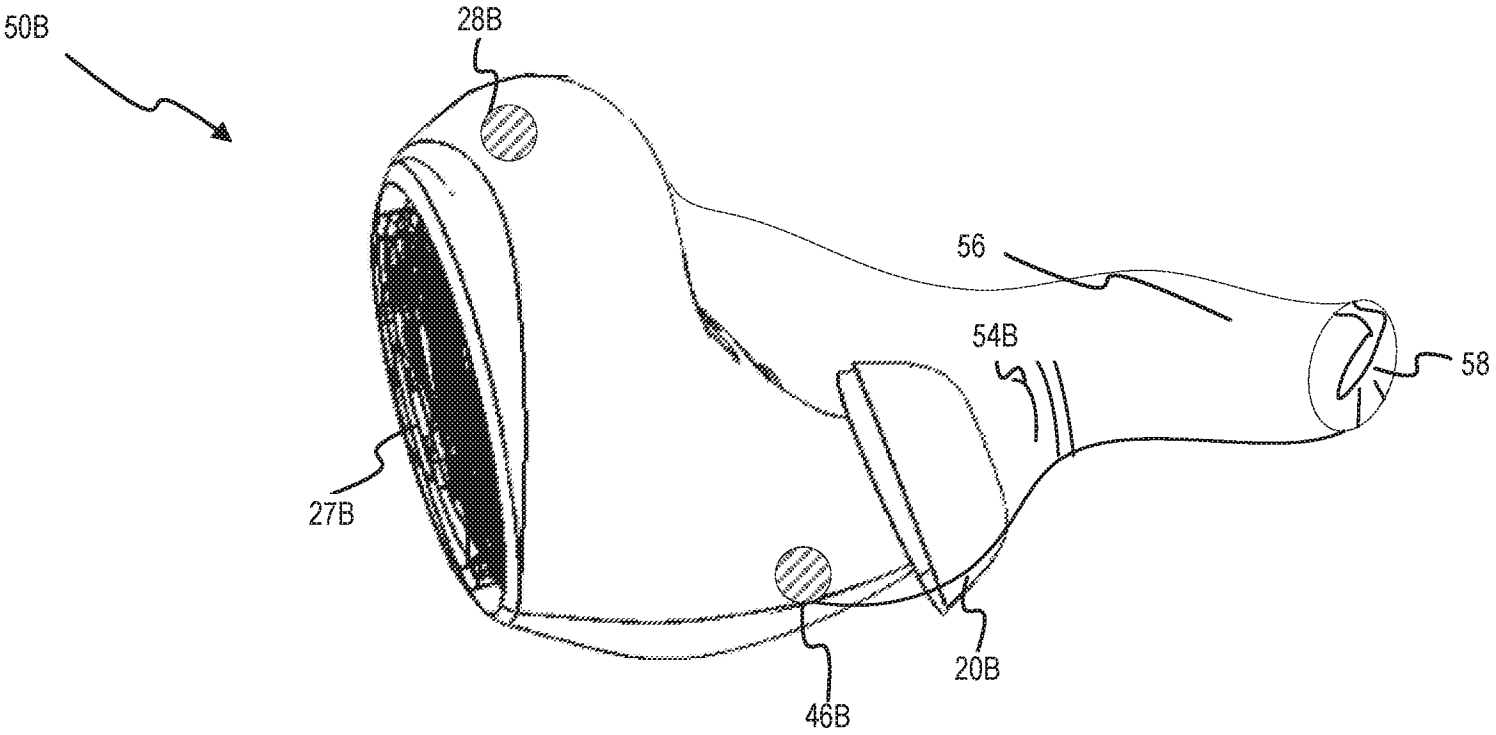
FIG. 6 illustrates a side view of a hearing aid in an ear in accordance with an embodiment of the present invention.

FIG. 6 illustrates a side view of the right hearing aid 50B and its relationship to a user's ear. The right hearing aid 50B may be configured to both minimize the amount of external sound reaching the user's external auditory canal 56 and to facilitate the transmission of the processed sound 54B from the speaker 20 to a user's tympanic membrane 58. The right hearing aid 50B may also be configured to be of any size necessary to comfortably fit within the user's external auditory canal 56 and the distance between the speaker 20B and the user's tympanic membrane 58 may be any distance sufficient to facilitate transmission of the processed sound 54B to the user's tympanic membrane 58.

There is a gesture interface 27B shown on the exterior of the earpiece. The gesture interface 27B may provide for gesture control by the user or a third party such as by tapping or swiping across the gesture interface 27B, tapping or swiping across another portion of the right hearing aid 50B, providing a gesture not involving the touching of the gesture interface 27B or another part of the right hearing aid 50B, or using an instrument configured to interact with the gesture interface 27B.

In addition, one or more sensors 28B may be positioned on the right hearing aid 50B to allow for sensing of user motions unrelated to gestures. For example, one sensor 28B may be positioned on the right hearing aid 50B to detect a head movement which may be used to modify one or more sounds received by the microphone 18B to minimize sound loss or remove unwanted sounds received due to the head movement. Another sensor, which may comprise a bone conduction microphone 46B, may be positioned near the temporal bone of the user's skull to sense a sound from a part of the user's body or to sense one or more sounds before the sounds reach one of the microphones due to the fact sound travels much faster through bone and tissue than air. For example, the bone conduction microphone 46B may sense a random sound traveling along the ground the user is standing on and communicate the random sound to processor 16B, which may instruct one or more microphones 18B to filter the random sound out before the random sound traveling through the air reaches any of the microphones 18B. More than one random sound may be involved. The operation may also be used in adaptive sound filtering techniques in addition to preventative filtering techniques.

Figure 7:
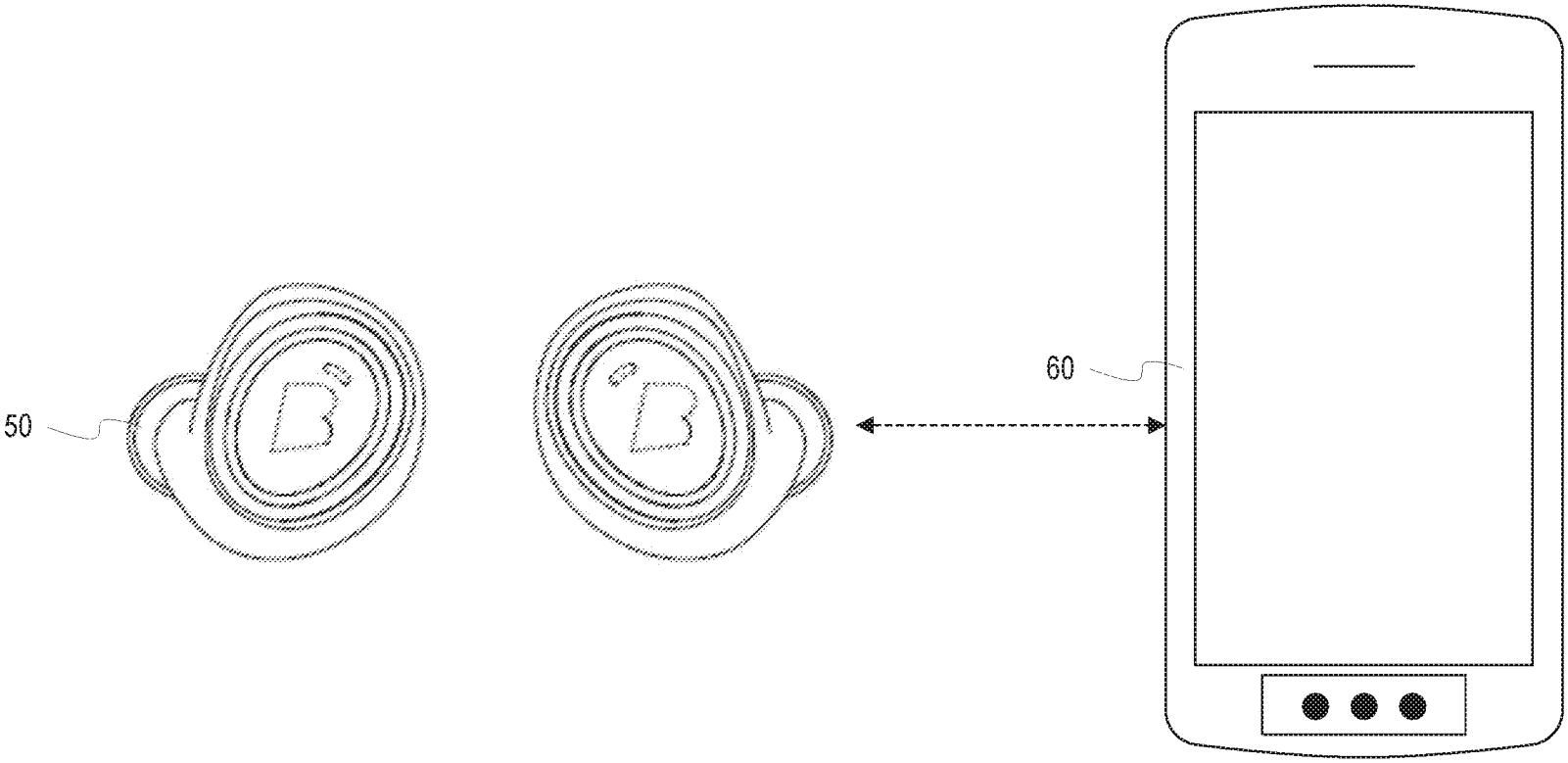
FIG. 7 illustrates a hearing aid and its relationship to a mobile device in accordance with an embodiment of the present invention.

FIG. 7 illustrates a pair of hearing aids 50 and their relationship to a mobile device 60. The mobile device 60 may be a mobile phone, a tablet, a watch, a PDA, a remote, an eyepiece, an earpiece, or any electronic device not requiring a fixed location. The user may use a software application on the mobile device 60 to select, control, change, or modify one or more functions of the hearing aid. For example, the user may use a software application on the mobile device 60 to access a screen providing one or more choices related to the functioning of the hearing aid pair 50, including volume control, pitch control, sound filtering, media playback, or other functions a hearing aid wearer may find useful. Selections by the user or a third party may be communicated via a transceiver in the mobile device 60 to the pair of hearing aids 50. The software application may also be used to access a hearing profile related to the user, which may include certain directions in which the user has hearing difficulties or sound frequencies the user has difficulty hearing. In addition, the mobile device 60 may also be a remote wirelessly transmitting signals derived from manual selections provided by the user or a third party on the remote to the pair of hearing aids 50.

Figure 8:
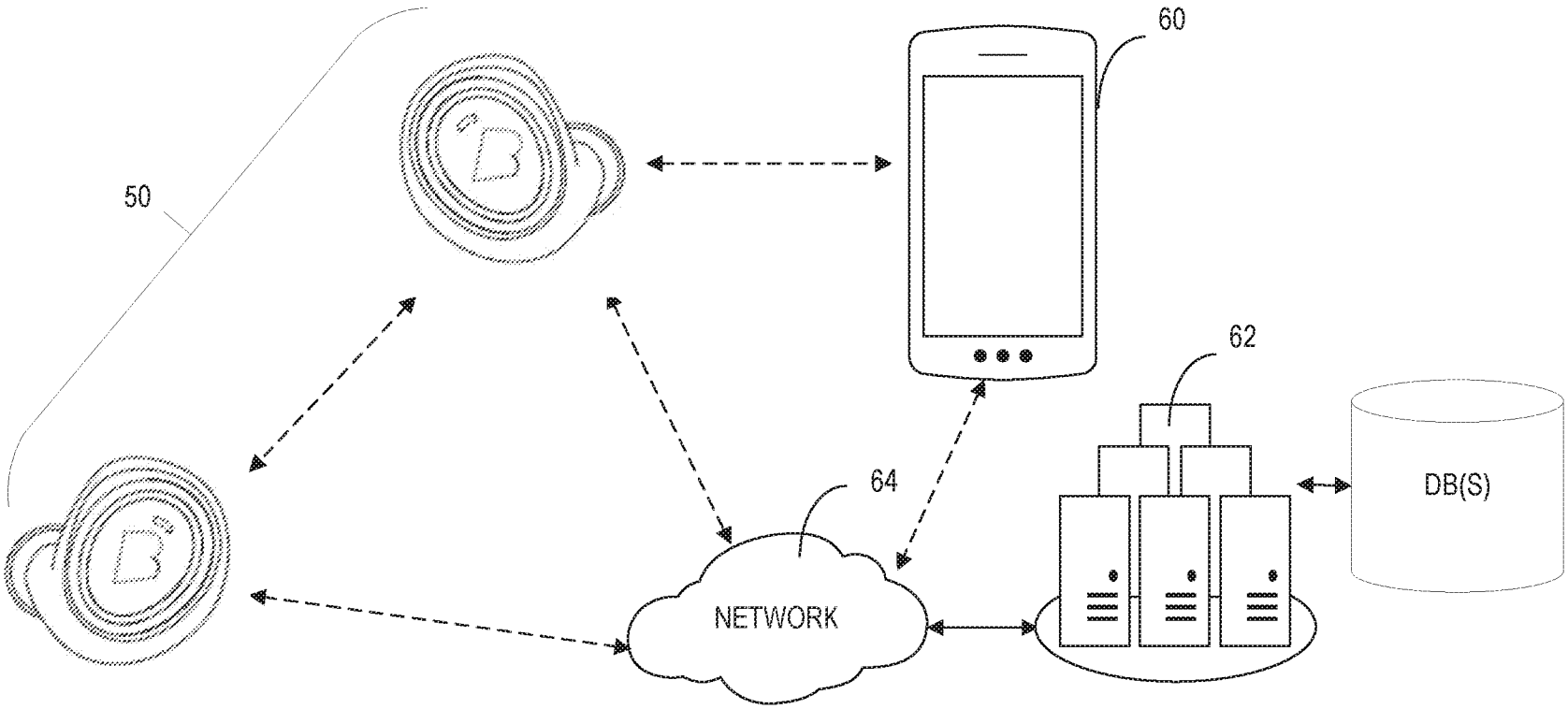
FIG. 8 illustrates a hearing aid and its relationship to a network in accordance with an embodiment of the present invention.

FIG. 8 illustrates a pair of hearing aids 50 and their relationship to a network 64. Hearing aid pair 50 may be coupled to a mobile phone 60, another hearing aid, or one or more data servers 62 through a network 64 and the hearing aid pair 50 may be simultaneously coupled to more than one of the foregoing devices. The network 64 may be the Internet, Internet of Things (IoT), a Local Area Network, or a Wide Area Network, and the network 64 may comprise one or more routers, one or more communications towers, or one or more Wi-Fi hotspots, and signals transmitted from or received by one of the hearing aids of hearing aid pair 50 traveling through one or more devices coupled to the network 64 before reaching their intended destination. For example, if a user wishes to upload information concerning the user's hearing to an audiologist or hearing clinic, which may include sensor data or audio files captured by a memory (e.g. 22A) operably coupled to one of the hearing aids 50, the user may instruct hearing aid 50A, 50B or mobile device 60 to transmit a signal encoding data, including data related to the user's hearing to the audiologist or hearing clinic, which may travel through a communications tower or one or more routers before arriving at the audiologist or hearing clinic. The audiologist or hearing clinic may subsequently transmit a signal signifying the file was received to the hearing aid pair 50 after receiving the signal from the user. In addition, the user may use a telecoil within the hearing aid pair 50 to access a magnetic signal created by a communication device in lieu of receiving a sound via a microphone. The telecoil may be accessed using a gesture interface, a voice command received by a microphone, or using a mobile device to turn the telecoil function on or off.

Figure 9:
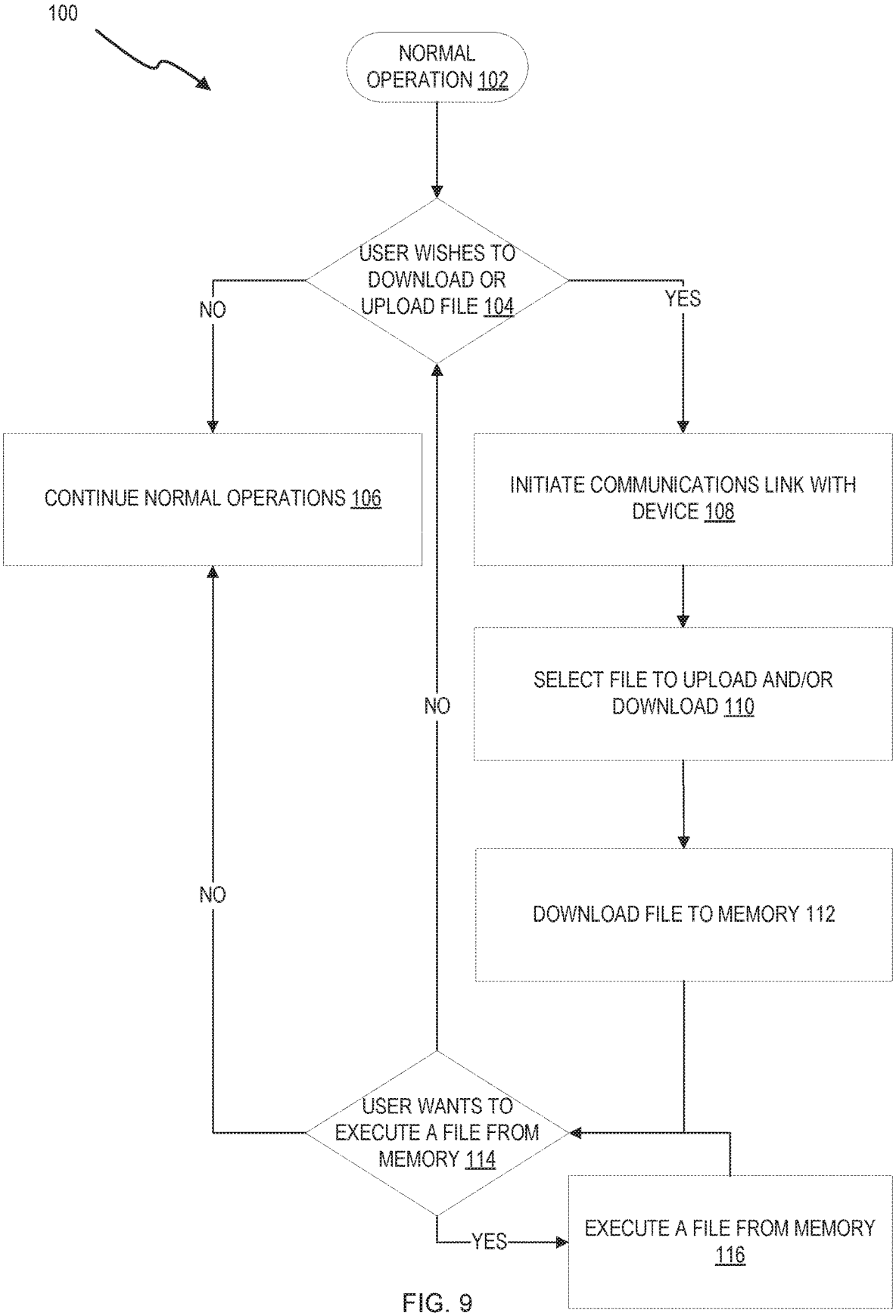
FIG. 9 illustrates a method of processing sound using a hearing aid in accordance with an embodiment of the present invention.

FIG. 9 illustrates a flowchart of a method of processing sound using a hearing aid 100. At state 102, hearing aid 50 is operating in a normal operation. For purposes of discussion, normal operation for hearing aid 50 is an operation in which hearing aid 50 is designed to provide hearing therapy for a user. In this operation the hearing aid is typically in one of three states: off (e.g., stored and/or charging), on but not receiving sound or on and receiving and modifying and/or shaping a sound wave according to the user's hearing loss as programmed by an audiologist. At state 104, using a voice command and/or a gesture, the user can instruct the hearing aids 50 to begin a download and/or an upload of a file to and/or from the hearing aids 50. If the user does not wish to upload and/or download a file to the hearing aids 50, then hearing aids 50 continue in normal operation at state 106. At state 108, hearing aids 50 can initiate a communication link using any forms of communication listed above with transceiver 31, wireless transceiver 32 and/or telecoil 35. The user can perform this operation verbally, tactily through gesture control 27 and/or a combination of both. The use could be walked down a list of possible communications partners such as, a network 64, a mobile device 60, an IPOD a computer or even a link to their audiologist.

At state 110, the user could then instruct hearing aid 50 which file they would like to upload and/or download to and/or from memory 22A. This file could be an audio file to be stored and played later, it could be a new executable file providing enhanced user operability of the hearing aid 50 from the device manufacturer, or it could be a file containing new DSP programming algorithm to enhance the user's sound enhancement on hearing aids 50. At state 112, hearing aid 50 downloads and/or uploads the file to memory 22A where it is stored.

At state 114, the user can elect to return to normal operations at state 106, choose to download/upload another file to memory 22A at state 104 or execute a file from memory at state 116. After the file at state 116 is executed, for example an audio file ends playing, hearing aids 50 can return to state 114 to ask the user if they wish to execute another file from memory.

Utilizing sound processing program 100 a user can update their sound settings for hearing aid 50 from their audiologist by simply sending them a recorded audiogram performed by hearing aid 50. After the audiologist examines the audiogram, they can make any necessary hearing changes to the hearing aids settings and send the new hearing aid programming to the user. The user can then download this file, store it in memory 22A and execute it to have their hearing aid settings updated. Further, a user can download songs and or other audio files to eliminate the need for an outside music player. Further, as the songs are onboard the hearing aid, they music can be run through the DSP processing for the user's hearing therapy needs all onboard the hearing aid. Further, should any enhancements be made by the hearing aid manufacturer and/or third party the user can download these enhancements from a network 64 and obtain enhanced functionality out of the hearing aid 50 without leaving the comfort of their home and/or work.

The features, steps, and components of the illustrative embodiments may be combined in any number of ways and are not limited specifically to those described. The illustrative embodiments contemplate numerous variations in the smart devices and communications described. The foregoing description has been presented for purposes of illustration and description. It is not intended to be an exhaustive list or limit any of the disclosure to the precise forms disclosed. It is contemplated other alternatives or exemplary aspects are considered included in the disclosure. The description is merely examples of embodiments, processes or methods of the invention. It is understood any other modifications, substitutions, and/or additions may be made, which are within the intended spirit and scope of the disclosure. For the foregoing, it can be seen the disclosure accomplishes at least all the intended objectives.

Although various embodiments have been shown and described herein, the present invention contemplates numerous alternatives, options, and variations. This may include variations in the number or types of processors, variations in the size, shape, and style of the hearing aid, variations in the number of speakers, variations in the number of microphones, variations in the types of files stored within the device, and other variations.

What is claimed is:

1. A hearing aid earpiece, comprising:

a hearing aid earpiece housing;

a processor disposed within the hearing aid earpiece housing for processing sound signals based on settings to compensate for hearing loss of an individual according to a hearing loss profile;

at least one microphone for receiving sound signals to be processed, the at least one microphone operatively connected to the processor;

at least one speaker for outputting sound signals to a user after processing of the sound signals, the at least one speaker within the hearing aid earpiece housing;

a memory disposed within the hearing aid earpiece housing and operatively connected to the processor;

a user interface operatively connected to the processor to allow the individual to communicate with the hearing aid;

wherein the hearing aid earpiece is configured to allow the individual to download and store files in the memory, the files comprising audio files including MP3 files and program files for executing on the processor to play the audio files including the MP3 files; and wherein the hearing aid earpiece is adapted to allow the individual to instruct the hearing aid earpiece to download the files from a computing device and store the files within the memory.

2. The hearing aid earpiece of claim 1 further comprising a rechargeable battery enclosed within the hearing aid earpiece housing.

3. The hearing aid earpiece of claim 2 further comprising a recharging interface operatively connected to the rechargeable battery to allow the rechargeable battery enclosed within the hearing aid earpiece housing to recharge.

4. The hearing aid earpiece of claim 1 further comprising a communications interface operatively connected to the processor to allow the hearing aid earpiece to communicate with another computing device.

5. A sound processing method for a hearing aid earpiece having the steps, comprising:

receiving through a user interface of the hearing aid earpiece a command from a user to begin download of a file to the hearing aid earpiece;

initiating communications to commence the download of the file to the hearing aid earpiece;

selecting through the user interface of the hearing aid earpiece the file to download to a user designated partition within a memory on the hearing aid earpiece; and downloading the file into the user designated partition within the memory of the hearing aid earpiece, wherein the file is an MP3 audio file.

* * * * *